US005883653A

United States Patent [19]

Sasaki

[11] Patent Number: 5,883,653

[45] Date of Patent: Mar. 16, 1999

[54] INK JET RECORDING DEVICE AND HEAD HOLDER WITH INK RESERVE SECTION HAVING A PLURALITY OF RESERVE GROOVES

[75] Inventor: Toyonori Sasaki, Anjo, Japan

[73] Assignee: Brother Kogyo Kabushiki Kaisha, Nagoya, Japan

[21] Appl. No.: 641,428

[22] Filed: May 1, 1996

[30] Foreign Application Priority Data

Jul. 12, 1995 [JP] Japan ..... 7-200569

[51] Int. Cl.[6] ..... B41J 2/175

[52] U.S. Cl. ..... 347/86; 347/86

[58] Field of Search ..... 347/84, 85, 86, 347/87, 36

[56] References Cited

U.S. PATENT DOCUMENTS 5,534,899 7/1996 Uchikata et al. ..... 347/49

FOREIGN PATENT DOCUMENTS 2100977 1/1994 Canada .
2 225 229 5/1990 United Kingdom .

OTHER PUBLICATIONS

Edds et al., Antiwetting Treatment For Fluid Container Walls; IBM Technical Disclosure Bulletin; pp. 3201–3202 Jan. 1978.

*Primary Examiner*—N. Le
*Assistant Examiner*—Michael Nghiem
*Attorney, Agent, or Firm*—Oliff & Berridge, PLC

[57] ABSTRACT

An ink jet recording device comprises an ink reserve section that includes a plurality of grooves in the bottom of a cartridge holding section of a head holder, which supports a recording head. Ink that may leak from the ink cartridge is held in the ink reserve section, and can be quickly dries by the capillary action of the grooves. This prevents the ink from spreading over the surface of the ink cartridge.

22 Claims, 8 Drawing Sheets

INK JET RECORDING DEVICE AND HEAD HOLDER WITH INK RESERVE SECTION HAVING A PLURALITY OF RESERVE GROOVES

BACKGROUND OF THE INVENTION

1. Field of the Invention

The invention relates to an ink jet recording device in which an ink cartridge containing ink is mounted in a head holder. The ink is supplied to a recording head provided in the head holder for recording on a suitable recording medium such as paper. In particular, the invention relates to an ink jet recording device which prevents ink that may be leaking at an ink supply port of the ink cartridge from spreading over the container body of the ink cartridge. Further, the ink jet recording device facilitates the mounting and removal of the ink cartridge onto the head holder.

2. Description of the Related Art

In a conventional ink jet recording device, ink is ejected from a plurality of nozzles in a recording head to record characters and images on paper. A head holder is normally mounted on a carriage, which is movable in a recording direction. The head holder has an ink jet mechanism for recording that comprises a recording head located opposite a recording medium and a cylindrical connecting tube section or manifold with an ink supply passage connected to the recording head. Furthermore, the ink cartridge contains the ink supplied to the recording head and has an ink supply port fit in the connecting tube section. The ink cartridge is removably mounted in the ink jet recording device.

A conventional ink jet recording device is shown in FIG. 8. It includes a head holder 128 horizontally mounted on a carriage. An ink cartridge 135 containing recording ink is a horizontally mounted-type cartridge and is mounted approximately horizontally on the head holder 128, in a direction indicated by arrow A.

The head holder 128 comprises a cartridge holding section for holding the ink cartridge 135. A cylindrical connecting tube section 132, which forms an ink supply passage 132A, is mounted on a vertical wall 128C of the head holder 128 facing the ink cartridge 135. The connecting tube section 132 protrudes from the cartridge holding section side and is provided with a recording head 131. A plurality of ejection nozzles, which eject the ink supplied through the ink supply passage 132A, are formed in the recording head 131. Furthermore, the connecting tube section 132 is fit with a cylindrical rubber sealing member 133 on the outside for preventing ink leakage.

A container body 136 of the ink cartridge 135 holds an ink absorbing body 137, which may be made of a porous material, such as a sponge. The absorbing body 137 is impregnated with the recording ink. A round ink supply port 136A is formed in the container body 136. The connecting tube section 132 can be inserted in the ink supply port 136A. When the ink cartridge 135 is mounted in the cartridge holding section, the connecting tube section 132 is inserted in the ink supply port 136A and advances into the ink cartridge 135. The connecting tube section 132 presses the ink absorbing body 137 so as to supply the ink from the ink absorbing body 137 to the recording head 131 via the ink supply passage 132A. Thus, the ink from the recording head 131 can record images. A gap at the ink supply port 136A can be hermetically closed by a sealing member 133 to prevent ink from leaking from the ink supply port 136A.

In a horizontally mounted ink jet recording device, in which the ink cartridge 135 is mounted horizontally in the cartridge holding section of the head holder with the recording head and the connecting tube section 132 disposed as described above, the sealing member 133 prevents ink leakage at the ink supply port 136A. However, when the ink cartridge 135 is mounted to the head holder 128, or if the ink cartridge 135 slightly vibrates or shakes via movement of the carriage during recording, ink is likely to leak out along the connecting tube section 132 and the sealing member 133.

The leaking ink may accumulate in a gap G between the ink cartridge 135 and the head holder 128. The ink can spread, for example by capillary action, between the contact surfaces of the head holder 128 and the ink cartridge 135. The ink that has permeated between the contact surfaces, does not contact air and is hard to dry. Thus, this ink remains in a liquid state in most cases. Therefore, when the ink cartridge 135 is removed, any leaked ink will spread and form a thin film over a bottom surface of the ink cartridge 135. This makes the device unattractive and can smear or dirty an operator's hands.

SUMMARY OF THE INVENTION

An object of the invention is to provide an ink jet recording device, which can prevent spreading of leaked ink from an ink cartridge after, or at, the time of mounting of the head holder. Further, the ink jet recording device facilitates the mounting and removal of the ink cartridge.

The ink jet recording device of the invention comprises a head holder for holding a recording head and an ink cartridge that is removably mounted in the head holder. The ink cartridge contains an ink that is to be supplied to the recording head. The ink jet recording device also comprises a cartridge holding section provided in the head holder for mounting the ink cartridge and an ink reserve or leakage holding section provided on the bottom wall section of the cartridge holding section in the head holder. The ink reserve section holds and reserves ink that has leaked from the ink supply port.

The ink that has leaked at the ink supply port is held and reserved in the ink reserving section formed in the bottom section of the cartridge holding section without spreading to neighboring contacting surfaces of the bottom wall section of the cartridge holding section and the ink cartridge. Therefore, it is possible to prevent ink that has leaked from widely spreading to the outside surfaces of the ink cartridge.

BRIEF DESCRIPTION OF THE DRAWINGS

The invention will be described in detail with reference to the following figures wherein.

DETAILED DESCRIPTION OF THE PREFERRED EMBODIMENT

Hereinafter a first preferred embodiment of an ink jet recording device according to the invention will be explained with reference to the accompanying drawings. The embodiment is described with a horizontal type ink jet recording device, in which an ink cartridge containing the recording ink is horizontally mounted however this is only exemplary and is not intended to limit the invention.

Figure 1:
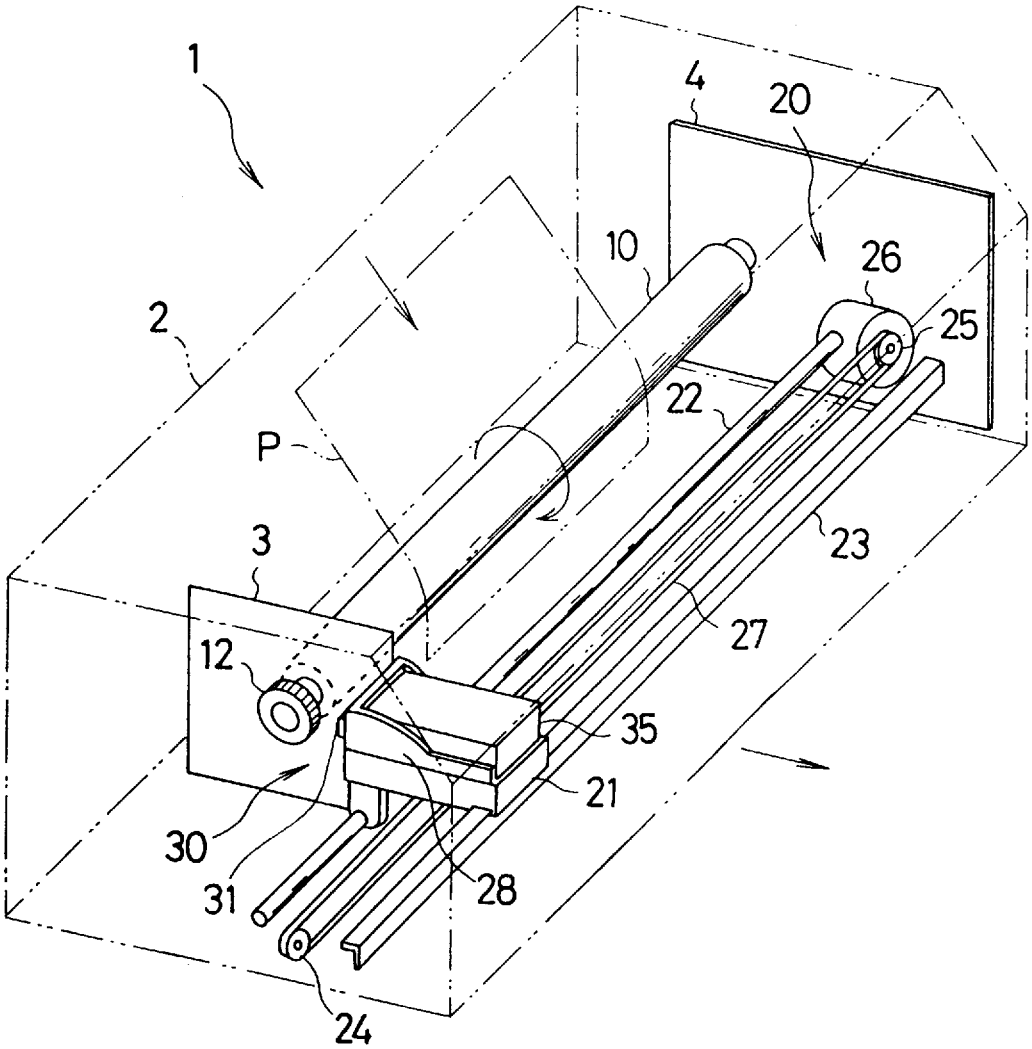
FIG. 1 is a schematic view of an ink jet recording device according to a first preferred embodiment of the invention.

The ink jet recording device 1, shown in FIG. 1, comprises a platen 10, a carriage driving mechanism 20, which drives a carriage 21, and an ink jet mechanism 30, which ejects recording ink in an ink cartridge 35 through a plurality of nozzles provided in a recording head 31 to paper P or other recording medium.

Figure 2:
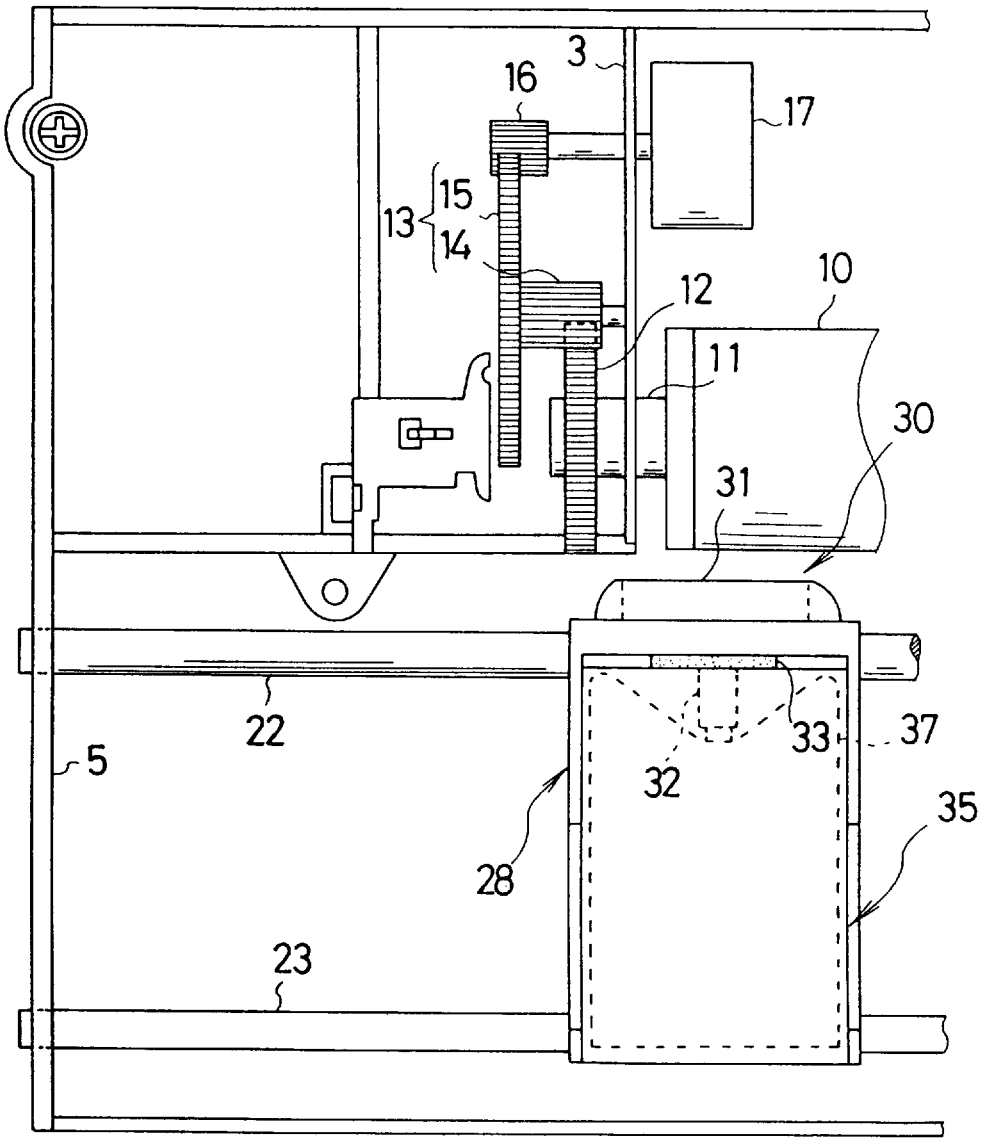
FIG. 2 is a partial plan view of the ink jet recording device of FIG. 1.

The platen 10, as shown in FIGS. 1 and 2, is transversely disposed, and rotatably supported by side wall plates 3 and 4 at the right and left ends of platen shaft 11. The left end of the platen shaft 11 is mounted to a platen gear 12. A compound gear 13, having a first driven gear 14 and a second driven gear 15, is rotatably pivoted on a side wall plate. A driving gear 16, which is meshed with the second driven gear 15, is mounted to a drive shaft of a feed motor 17. When the feed motor 17 is driven in a specific direction of rotation, the driving gear 16 is rotated so a to drive the platen 10 in a paper feed direction through the compound gear 13 and the platen gear 12.

Next, the carriage driving mechanism 20 will be explained with reference to FIGS. 1 and 2. Plate-like carriage 21 is horizontally positioned in the front of the platen 10. The carriage 21 is transversely movably supported at its rear end on a guide rod 22. A guide rod 22 is disposed in parallel with the platen 10. The carriage 21 is transversely movably supported at the front end on a guide rail 23, which is in parallel with the guide rod 22. The guide rod 22 and the guide rail 23 are supported at their right and left ends on side wall plates 4 and 5.

At the left end of travel for the carriage 21, a pulley 24 is rotatably pivoted on a frame. At the right end of travel for the carriage 21, a drive pulley 25 is mounted on the drive shaft of a carriage driving motor 26. An endless timing belt 27 is installed on pulleys 24 and 25. The timing belt 27 is positioned at the lower end of the carriage 21. When the carriage driving motor 26 rotates, the carriage 21, which is supported on the guide rod 22 and the guide rail 23, moves to the right for recording, and returns to the left without recording.

Figure 3:
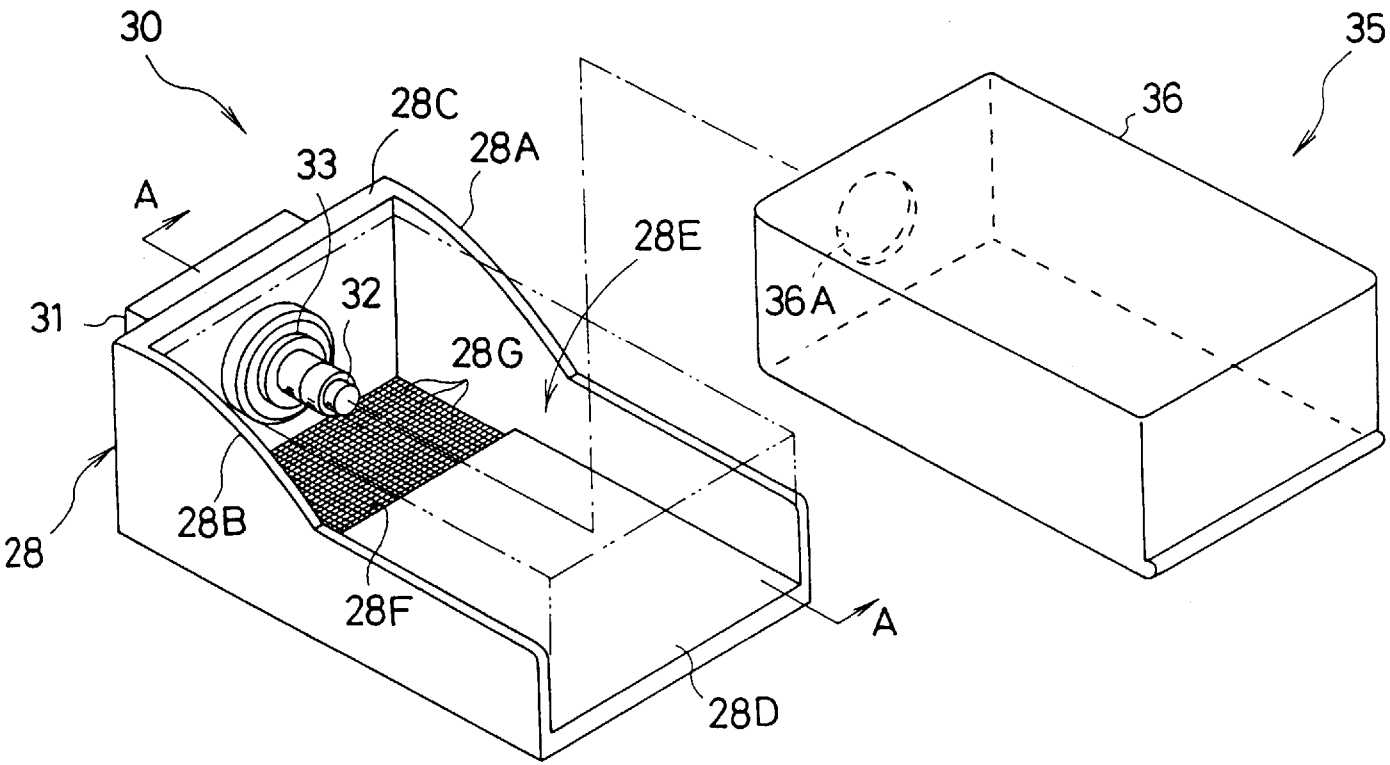
FIG. 3 is a perspective view of a head holder and an ink cartridge of FIG. 1.

A box-like head holder 28, which is open at top and at front, is removably secured on the carriage 21. The head holder 28 is provided with a cartridge holding section 28E, which is supported on a pair of side wall sections 28A and 28B, as seen in FIG. 3.

A rectangular recessed ink reserve or holding section 28F is formed at a part of a bottom wall section 28D of the cartridge holding section 28E below a connecting tube section 32. The ink reverse section 28F extends a specific length in the longitudinal direction over the entire width of the cartridge holding section 28E. A plurality of ink reserve grooves 28G defining a plurality of fine crimps extend longitudinally and transversely over the entire ink reserve section 28F.

Figure 4:
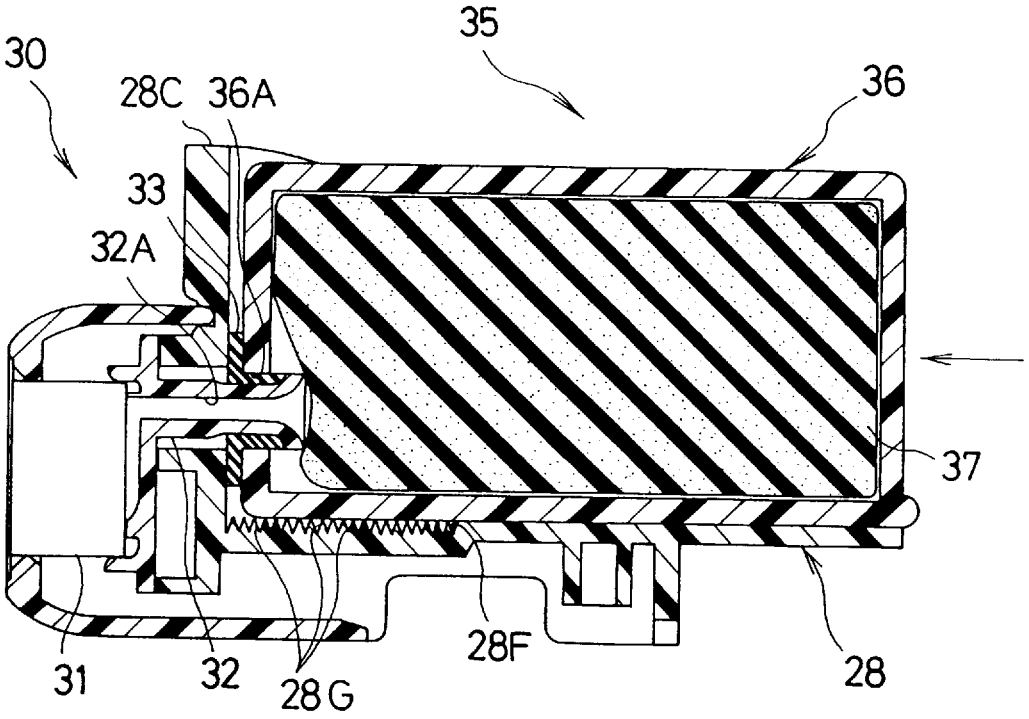
FIG. 4 is a longitudinal view taken along line A-A of FIG. 3 of FIG. 1.

The ink reserve grooves 28G, as shown in FIG. 4, have an approximately triangular cross-sectional shape, and are capable of holding and absorbing the ink, for example by a capillary action. A top portion of the plurality of ink reserving grooves 28G at the apex of the triangular portions can contact a lower end surface of the container body 36 when the ink cartridge 35 is mounted. Thus, any ink that has leaked, is absorbed by capillary action to the plurality of ink reserve grooves 28G, and gradually spreads out, both longitudinally and transversely. An enlarged air contact surface area, which is defined by the grooves 28G, will allow quick drying of the ink.

Next, the ink jet mechanism 30 that ejects the ink for recording images on the paper, will be explained with reference to FIGS. 1–4. A horizontally mounted the recording head 31, including a plurality of nozzles and ink supply passages passing therethrough, are formed on the rear end surface of the rear wall section 28C of the head holder 28. The connecting tube section 32 with the ink passage 32A, which communicates with the plurality of ink supply passages, protrudes from the cartridge holding section 28E side. A ring-like rubber sealing member 33 is fit on the connecting tube section 32 to prevent leakage of ink from the ink supply port 36A of the ink cartridge 35 mounted. The ink is ejected from the recording head 31 of the ink jet mechanism 30 to record images on the paper P.

The ink cartridge 35 will now be explained with reference to FIGS. 1–4. The container body 36 of the ink cartridge 35 is a box-like element formed of a suitable material, such as a synthetic resin 36. An ink holding material 37 produced of a porous material, such as a urethane foam soaked with the recording ink is provided in the container body. An ink supply port 36A is formed on the rear end wall of the container body 36, and can be fit on the outside surface of the connecting tube section 32.

Next, the spreading action of ink for drying the leaked ink will be explained with reference to FIGS. 3 and 4. When the ink cartridge 35 is mounted to the cartridge holding section 28E, the connecting tube section 32 is inserted in the ink supply port 36A. The connecting tube section 32 advances into the ink cartridge 35 and presses the ink absorbing body 37. Thus, the ink is fed to the recording head 31, via the ink supply passage 32A of the connecting tube section 32, and subsequently ejected by the recording head to record images.

A gap that may exist between the ink supply port 36A and the connecting tube section 32, is hermetically closed with the sealing member 33. However, the ink cartridge 35 tends to slightly vibrate or shake the movement of the carriage when the ink cartridge is mounted or during recording. Ink is likely to leak out from the ink absorbing body 37, even in minute amounts, via the connecting tube section 32 and the sealing member 33. The ink can seep down along the rear end wall of the ink cartridge 35 and the front surface of the rear wall section 28C of the head holder 28.

The plurality of ink reserving grooves 28G are formed in the recessed ink reserve section 28F below the connecting tube section 32. Thus, ink that has seeped down along the rear end wall of the ink cartridge 35 will be absorbed by the capillary action of the plurality of ink reserving grooves 28G. Moreover, the ink that has seeped down along the front surface of the rear wall section 28C is absorbed by the capillary action of the plurality of ink reserve grooves 28G. Therefore, the ink leaking from the ink cartridge 35 will not spread over the contacting surfaces of the bottom surface of the container body 36 and the ink cartridge holding section 28E.

The ink that has been absorbed into the ink reserve grooves 28G gradually spreads both longitudinally and transversely, along the ink reserve grooves 28G. The ink does not attach itself to the bottom surface of the container body 36. This increases the air contact surface area, and accordingly the ink dries quickly.

The recessed ink reserve section 28F is formed on the bottom wall section of the cartridge holding section 28E below the connecting tube section 32 of the head holder 28. The plurality of ink reserve grooves 28G are formed in the ink reserve section 28F. Accordingly, the ink that has leaked at the ink supply port 36A of the ink cartridge 35 will not extensively attach itself to the outer surface of the ink cartridge 35. Even in the case of a minor leak, the ink can be thoroughly absorbed by the capillary action of the plurality of ink reserve grooves 28G, thus quickly drying. The ink that has leaked, will not drip from the ink cartridge 35 nor stain the operator's hands when the ink cartridge 35 is removed. Furthermore, since the ink does not spread, the operator's hands will not be stained when the head holder 28 is removed for replacement with the recording head 31.

Figure 5A:
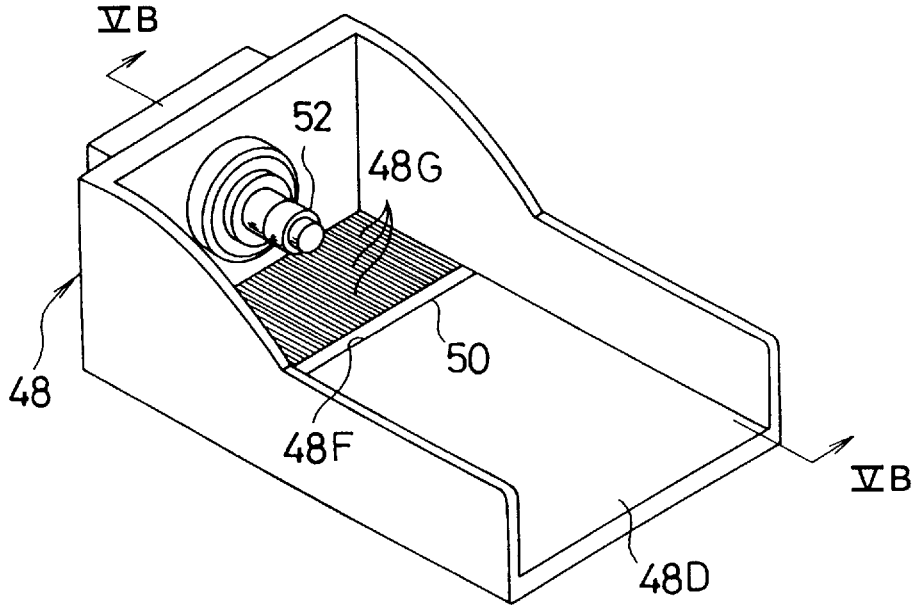
FIG. 5A is a perspective view of the head holder provided with ink reserving grooves formed in a longitudinal direction according to a second preferred embodiment of the invention.
Figure 5B:
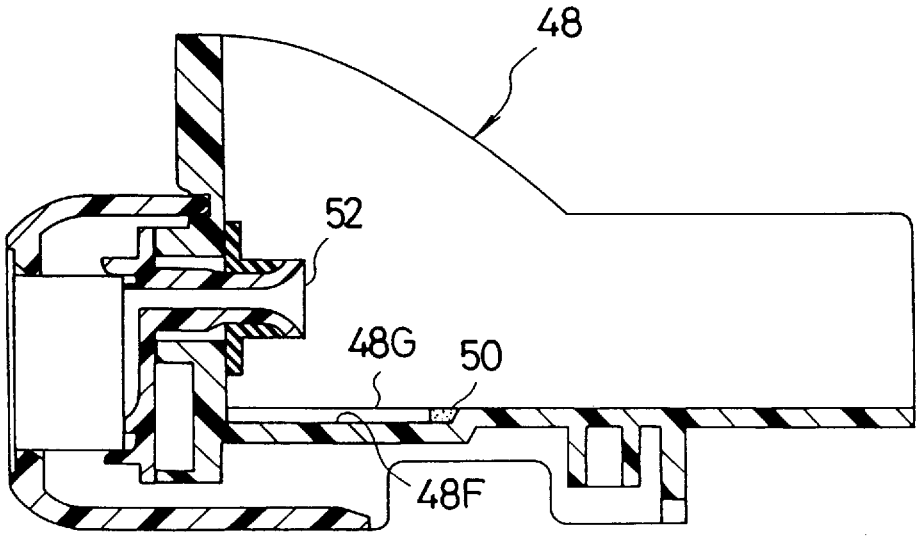
FIG. 5B is a longitudinal side view taken along line B—B of Fig A.

A second preferred embodiment of the invention is shown in FIGS. 5A and 5B. A recessed ink reserve section 48F in a bottom wall section 48D of a head holder 48 is positioned beneath a connecting tube section 52. A plurality of ink reserve grooves 48G longitudinally and transversely extend in the ink reserve section 48F. An ink absorbing body 50 made of a porous material, such as for example sponge, may be provided at a front end section of the ink reserve section 48F. The ink absorbing body 50 may extend across the plurality of reserve grooves 48G between side walls of the head holder. Thus, ink that has leaked from the ink supply port of an ink cartridge can be thoroughly absorbed by capillary action of the plurality of ink reserve grooves 48G, and be quickly dried. Moreover, with substantial ink leakage, ink can be absorbed by the ink absorbing body 50, thus preventing ink seepage and attachment to the ink cartridge. The ink absorbing body 50 may be formed with any appropriate cross-section.

Figure 6:
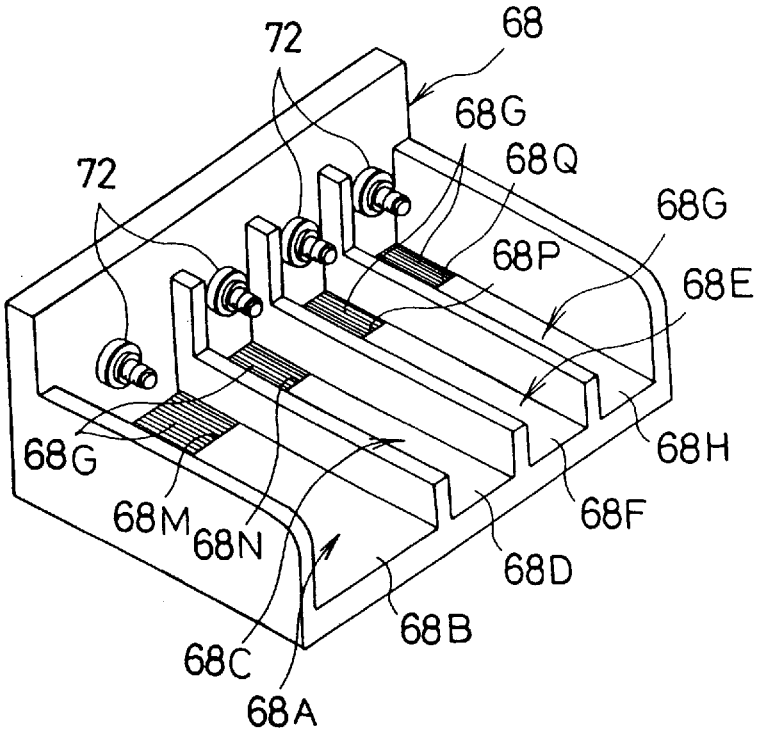
FIG. 6 is a perspective view of the head holder according to a third preferred embodiment of the invention.

Furthermore, a third preferred embodiment of the invention is shown in FIG. 6. Recessed ink reserve sections 68M, 68N, 68P and 68Q are positioned beneath connecting tube sections 72 in bottom wall sections 68B, 68D, 68F and 68H of cartridge holding sections 68A, 68C, 68E and 68G in the head holder 68. Ink cartridges, for example, of four colors including black, cyan, magenta and yellow, can be horizontally mounted in the cartridge holding sections 68A–68D. A plurality of ink reserve grooves 68G may be provided in each of the ink reserve sections 68M, 68N, 68P and 68Q. The ink reserve sections 68M, 68N, 68P and 68Q may be continuously formed as one unit. The ink reserve grooves may also be provided in the wide ink reserve sections and/or an ink absorbing body. In this case also, the same effect as above will be obtained.

Figure 7:
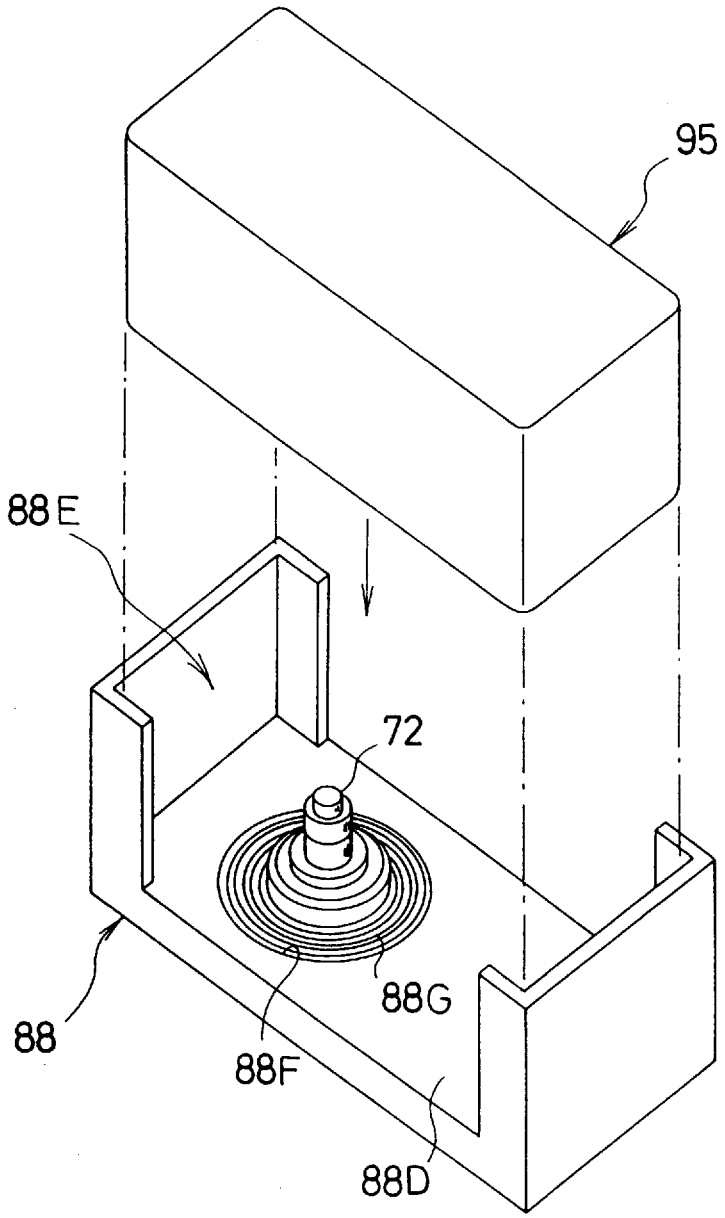
FIG. 7 is a perspective view of the head holder according to a fourth preferred embodiment of the invention.
Figure 8:
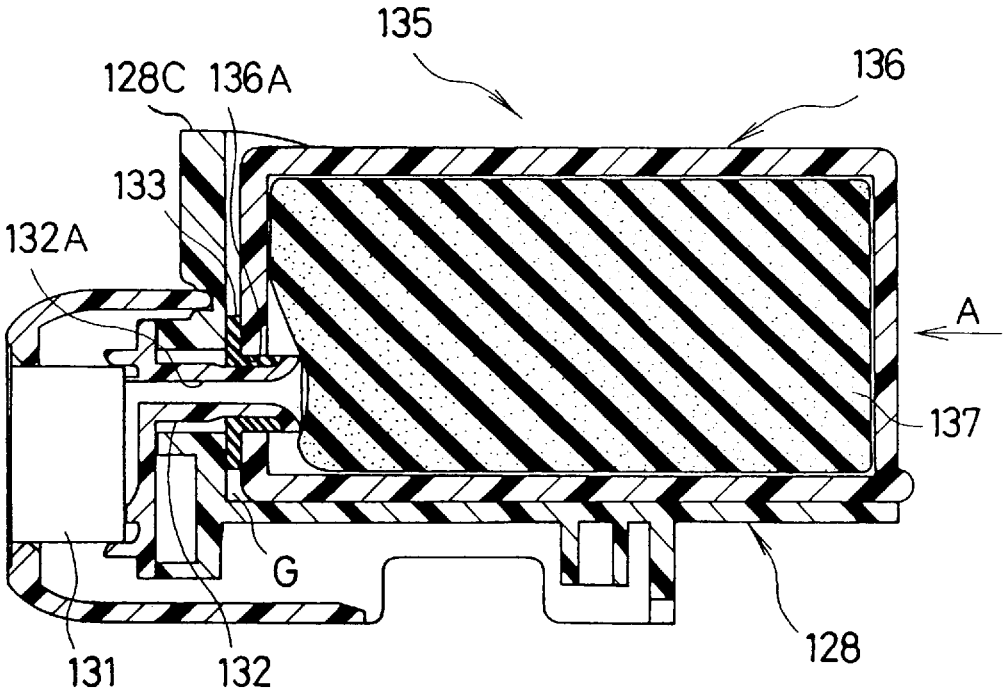
Fig.8 PRIOR ART
FIG. 8 is a longitudinal side view of a major portion of the head holder mounted with the ink cartridge of a conventional ink jet recording device.

A fourth preferred embodiment of the invention is shown in FIG. 7. A head holder 88 comprises a cartridge holding section 88E, where an ink cartridge 95 is vertically mounted in a downward direction. A ring-like recessed ink reserve section 88F is formed on the outer periphery of the connecting tube section 72. A bottom wall section 88D is formed in a cartridge holding section 88E. A plurality of ring-like (e.g., generally arcuate or circular) or radial ink reserve grooves 88G are formed in the ink reserve section 88F. The same effect as above can be obtained by this structure. Furthermore, a thin annular ink absorbing body 88H may be provided in the ink reserve section 88F.

The ink reserve grooves provided in the ink reserve section are not limited to straight grooves. The grooves may take any appropriate shape, such as staggered or sinusoidal. Further, various changes and modifications may be added by adding reserve grooves in the lower end part of the rear wall section of the head holders 28, 48. Furthermore, an ink absorbing body may be positioned over the entire surface of the ink reserve section. The invention is applicable to various types of ink jet recording devices such as an ink jet recording device with the head holders 28 and 48 mounted at an incline on the rear wall section side and with the ink cartridge mounted at an obliquely lower part. Alternatively, the ink jet recording device may comprise head holders 28, 48 integrally formed with the carriage 21.

What is claimed is:

1. An ink jet recording device, comprising:

a recording head;

a head holder for holding the recording head, the head holder having a connecting part connected to the recording head;

an ink cartridge containing ink, the ink cartridge being removably mounted in said head holder and supplying the ink to the recording head, the ink cartridge comprising an ink supply port connected to the connecting part for connecting the ink cartridge to the recording head;

an ink reserve section provided in said head holder, the ink reserve section having a plurality of reserve grooves for holding ink that leaks from said ink cartridge and for allowing the ink to dry; and an ink absorbing body positioned adjacent and substantially level with the reserve grooves such that the ink absorbing body and the reserve grooves form a flush surface, the ink absorbing body absorbing ink in the reserve grooves, wherein an end of at least one of the reserve grooves abuts the ink absorbing body.

2. A device according to claim 1, wherein said ink reserve section is adjacent said connecting part.

3. a device according to claim 1, wherein the reserve grooves have a generally triangular cross-sectional shape with raised apexes.

4. A device according to claim 3, wherein the raised apexes of the plurality of reserve grooves contact the ink cartridge when said ink cartridge is mounted in said head holder.

5. A device according to claim 1, wherein the plurality of reserve grooves are generally arcuate.

6. A device according to claim 1, wherein the plurality of reserve grooves are generally circular.

7. A device according to claim 1, wherein said cartridge holding section includes a bottom wall section, wherein said ink reserve section is formed in said bottom wall section.

8. A device according to claim 7, wherein said ink reserve section is formed as a recess.

9. A device according to claim 7, wherein the ink reserve section extends over a portion of the cartridge holding section.

10. A device according to claim 8, wherein said head holder comprises at least two side walls, the cartridge holding section is provided between said at least two side walls and the ink reserve section extends between said at least two side walls.

11. A head holder for mounting an ink cartridge containing ink, the head holder comprising:

a cartridge holding section for receiving said ink cartridge therein, the cartridge holding section having a width;

an ink leakage holding section provided in said cartridge holding section, the ink leakage holding section having a plurality of reserve grooves for holding ink that leaks from said ink cartridge when mounted in said cartridge holding section and for allowing the ink to dry, the plurality of reserve grooves being provided along the width of the cartridge holding section so that ink leakage is spread among the plurality of reserve grooves to enhance drying of the ink; and an ink absorbing body positioned adjacent and substantially level with the plurality of reserve grooves, to form a flush surface wherein an end of at least one of the reserve grooves abuts the ink absorbing body.

12. A head holder according to claim 11, wherein said head holder further comprises a connecting part having a first end for connection to a recording head and a second end for connection to said ink cartridge to supply ink to said recording head, said ink leakage holding section being provided adjacent said connecting part.

13. A head holder according to claim 11, wherein the reserve grooves have a generally triangular cross-sectional shape with raised apexes.

14. A head holder according to claim 13, wherein the raised apexes of the plurality of reserve grooves contact the ink cartridge when the ink cartridge is mounted in said head holder.

15. A head holder according to claim 11, wherein said ink leakage holding section comprises an ink absorbing body for absorbing the ink.

16. A head holder according to claim 11, wherein said cartridge holding section includes a bottom wall section, and wherein said ink holding leakage section is formed in said bottom wall section.

17. A head holder according to claim 16, wherein said ink leakage holding section is formed as a recess.

18. A head holder according to claim 16, wherein said ink leakage holding section extends over a portion of the cartridge holding section.

19. A head holder according to claim 17, wherein said head holder comprises at least two side walls, the cartridge holding section is provided between said at least two side walls and the ink leakage holding section extends between said at least two side walls.

20. A head holder according to claim 19, wherein said ink leakage holding section comprises an ink absorbing body for absorbing the ink, the ink and absorbing body is located at one end of the ink leakage holding section.

21. A head holder according to claim 11, wherein the plurality of reserve grooves are generally arcuate.

22. A head holder according to claim 11, wherein the plurality of reserve grooves are generally circular.

* * * * *